US010724271B2

(12) United States Patent
Sangster et al.

(10) Patent No.: US 10,724,271 B2
(45) Date of Patent: Jul. 28, 2020

(54) INDEPENDENT RX SPRING CARTRIDGE FOR A MORTISE LOCK

(71) Applicant: SARGENT MANUFACTURING COMPANY, New Haven, CT (US)

(72) Inventors: Rick Sangster, New Haven, CT (US); Walter Mori, Madison, CT (US)

(73) Assignee: Sargent Manufacturing Company, New Haven, CT (US)

( * ) Notice: Subject to any disclaimer, the term of this patent is extended or adjusted under 35 U.S.C. 154(b) by 363 days.

(21) Appl. No.: 15/656,667

(22) Filed: Jul. 21, 2017

(65) Prior Publication Data

US 2018/0030757 A1 Feb. 1, 2018

Related U.S. Application Data

(60) Provisional application No. 62/367,869, filed on Jul. 28, 2016.

(51) Int. Cl.
*E05B 15/04* (2006.01)
*E05B 13/00* (2006.01)
(Continued)

(52) U.S. Cl.
CPC ..... *E05B 13/004* (2013.01); *E05B 15/0033* (2013.01); *E05B 15/04* (2013.01); *E05B 17/22* (2013.01); *E05B 63/08* (2013.01); *E05B 63/16* (2013.01); *E05B 47/0603* (2013.01); *E05B 47/0657* (2013.01); *E05B 2015/041* (2013.01); *E05B 2015/0437* (2013.01);
(Continued)

(58) Field of Classification Search
CPC ..... Y10S 292/61; Y10T 292/14; E05B 15/04; E05B 63/08; E05B 13/004
USPC ..... 292/163
See application file for complete search history.

(56) References Cited

U.S. PATENT DOCUMENTS 2,890,475 A * 6/1959 Carlson ..... E05F 5/02 16/82
4,653,784 A * 3/1987 Lee ..... E05C 19/02 292/71
(Continued)

FOREIGN PATENT DOCUMENTS

EP 2385197 A2 * 11/2011 ..... E05B 13/004
FR 2549516 A1 * 1/1985 ..... E05B 9/00
(Continued)

*Primary Examiner* — Carlos Lugo
(74) *Attorney, Agent, or Firm* — DeLio Peterson & Curcio LLC; David R. Pegnataro

(57) ABSTRACT

A spring cartridge for a mortise lock includes a housing adapted to be secured within the mortise lock housing, and first and second members slideable with respect to the spring cartridge housing, the first and second members each having a first end adapted to contact an outer surface of first and second spindle hubs and being independently actuable along a longitudinal axis of the spring cartridge housing in response to rotation of the first or second spindle hub. A spring retained by the spring cartridge housing contacts a second end of the first and second members to bias each of the members against the outer surface of the first and second spindle hubs, respectively. Upon rotation of one of the hubs, the member contacting the hub permits the hub to rotate, while the member contacting the other hub prevents the other hub from rotating.

16 Claims, 8 Drawing Sheets

(51) Int. Cl.

| | |
|---|---|
| ***E05B 63/16*** | (2006.01) |
| ***E05B 15/00*** | (2006.01) |
| ***E05B 17/22*** | (2006.01) |
| ***E05B 63/08*** | (2006.01) |
| *E05B 47/06* | (2006.01) |
| *E05B 47/00* | (2006.01) |

(52) U.S. Cl.
CPC ..... *E05B 2015/0486* (2013.01); *E05B 2047/0067* (2013.01); *Y10S 292/61* (2013.01)

(56) References Cited

U.S. PATENT DOCUMENTS 4,662,664 A * 5/1987 Wendt ..... A47K 10/36 292/19
4,911,488 A * 3/1990 Brackmann ..... E05B 85/045 200/61.64
5,263,749 A * 11/1993 Errani ..... E05B 59/00 292/245
5,678,870 A 1/1997 Pelletier
5,765,883 A * 6/1998 Dessenberger ..... B64D 29/06 292/240
6,282,929 B1 9/2001 Eller et al.
6,302,456 B1 * 10/2001 Errani ..... E05B 59/00 292/165
6,398,274 B1 6/2002 Huang et al.
6,669,249 B1 * 12/2003 Huang ..... E05B 9/02 292/337
6,869,116 B2 * 3/2005 Dalsing ..... E05B 3/065 292/336.3
7,077,437 B2 7/2006 Huang
7,188,870 B2 3/2007 Huang
7,303,216 B2 * 12/2007 Bella ..... E05B 77/06 292/303
7,452,012 B2 11/2008 Huang
8,100,441 B2 * 1/2012 Liao ..... E05C 19/022 292/300

FOREIGN PATENT DOCUMENTS

FR 2569755 A1 * 3/1986 ..... E05B 15/04
GB 2323626 A * 9/1998 ..... E05B 15/04
GB 2358667 * 1/2001

* cited by examiner

FIG. 8
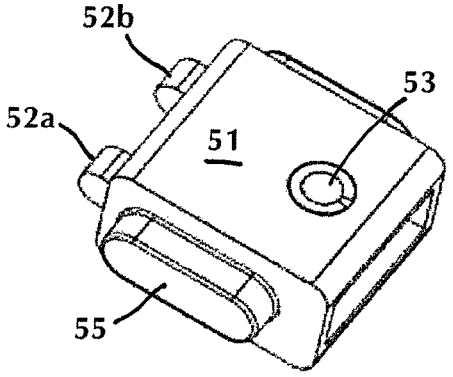
FIG. 9
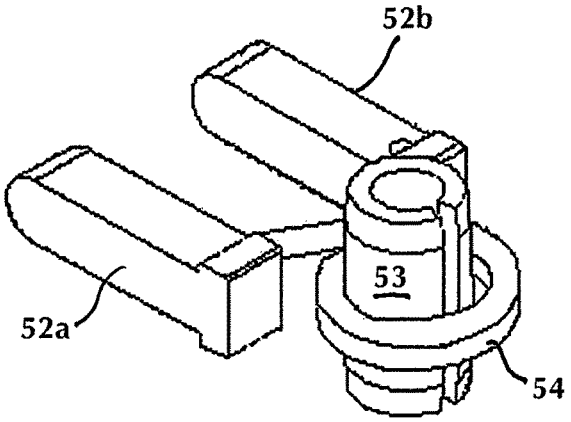
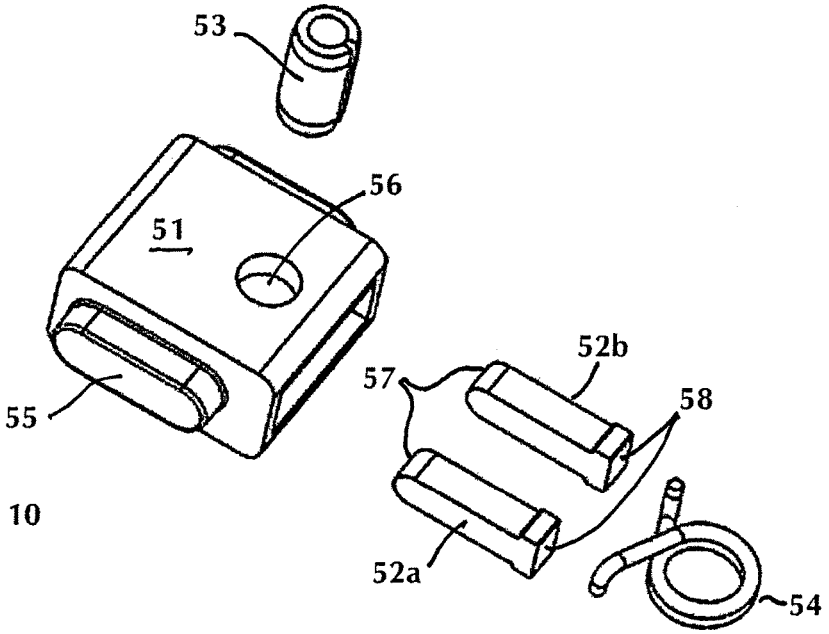
FIG. 10

INDEPENDENT RX SPRING CARTRIDGE FOR A MORTISE LOCK

BACKGROUND OF THE INVENTION

1. Field of the Invention

The present invention relates generally to lock devices, such as mortise locks, that incorporate multiple electronic components, such as magnetic sensors to sense the positions of moving components in the lock, such as the latch bolt, the deadbolt and the like. More specifically, the present invention relates to an improved mortise lock design which allows for independent support of each spindle hub during actuation of a lever or handle on either side of the lock.

2. Description of Related Art

The conventional design for a mortise lock includes a pair of spindle hubs which may be independently actuated by the turning of a door handle on either side of a door, wherein determining if the hub to be turned by the door handle is actually locked or unlocked is measured by a sensor adjacent the hub and monitored by a control unit. In one example, a sensor is used to monitor a locking piece which translates in and out of engagement with a slot in the spindle hub to lock and unlock the lock mechanism. The locking piece may be translated by an actuator assembly including a solenoid or motor, upon receiving a signal from a control unit in an external device.

During operation, mortise locks require the non-actuated lever or handle side of the lock to be supported to stop the hub from activating the sensor for that side of the door. In some mortise lock designs, this is accomplished by means of a hub return spring which supports both hubs simultaneously (FIG. 1, prior art). A hub return spring is not ideal, as it presents quality control concerns and, importantly, during actuation of the lever or handle on one side of the lock, the non-actuated hub on the opposing side of the lock is left unsupported, which can result in inadvertent tripping of the sensor at the non-actuated side of the lock.

One method of solving these performance obstacles is by using an external spring clip and a pair of indexing plates, one on either side of the door. Each indexing plate includes a plurality of dimple slots associated with dimples in the external spring clip. Each indexing plate is associated with either the cap side hub or case side hub. When the handle or level on one side of the door is turned to move the associated hub, the corresponding indexing plate on that side of the door springs out of the dimples in the external spring clip to allow for actuation, while the opposite hub remains locked and held in place by way of the dimple slots remaining in communication with the dimples in the external spring clip. This external spring clip solution is not ideal because the dimples eventually wear out after a period of time, eliminating the independent support of each hub which had been afforded by the indexing plate/dimple slot configuration. Moreover, this external solution requires additional door prep work and boring of the "pocket" into which the mortise lock is fit in the door, as well as additional tooling. An internal solution is preferred which would eliminate the additional tooling and prep requirements.

Therefore, a need exists for an improved internal mortise lock hub support which will allow for independent support for each spindle hub, thereby preventing accidental activation of the sensor on the non-actuated side of the lock.

SUMMARY OF THE INVENTION

Bearing in mind the problems and deficiencies of the prior art, it is therefore an object of the present invention to provide an improved mortise lock that incorporates multiple electronic components, such as magnetic sensors to sense the positions of moving components in the lock.

It is another object of the present invention to provide an internal solution for improved hub support in a mortise lock, which will allow for independent support for each spindle hub.

A further object of the invention is to provide a spring cartridge for engaging each of a pair of spindle hubs in a mortise lock to allow for independent support for each spindle hub.

Still other objects and advantages of the invention will in part be obvious and will in part be apparent from the specification.

The above and other objects, which will be apparent to those skilled in the art, are achieved in the present invention which is directed to a spring cartridge for a mortise lock for engaging first and second spindle hubs rotatable by a handle to open and close a latchbolt. The spring cartridge comprises a housing adapted to be secured within a mortise lock housing, and first and second members slideable with respect to the spring cartridge housing. The first and second members each have a first end adapted to contact an outer surface of the first and second spindle hubs, wherein the first and second members are independently actuable along a longitudinal axis of the spring cartridge housing in response to rotation of the first or second spindle hub. A spring, such as a torsion spring, retained by the spring cartridge housing and in contact with a second end of the first and second members biases each of the first and second members against the outer surface of the first and second spindle hubs, respectively, wherein upon rotation of one of the hubs only, the member contacting the hub permits the hub to rotate, while the member contacting the other hub prevents the other hub from rotating.

The first and second members may be pins and the first ends of the first and second pins may be engageable with detents in the outer surface of the first and second spindle hubs, respectively. The spring cartridge may further comprise a roll pin positioned transversely through the spring cartridge housing, wherein the spring is retained by the roll pin.

In an embodiment, the spring cartridge housing may include a lip adapted to be held in a slot in the mortise lock cover plate.

In another aspect the present invention is directed to a mortise lock comprising a lock housing, a lock having first and second spindle hubs rotatable by a handle to open and close a latchbolt, the hubs being alternately lockable and unlockable to prevent and permit movement of the hub and latchbolt, and a spring cartridge comprising two independently moveable members, one member in contact with the first spindle hub and the other member in contact with the second spindle hub, wherein upon rotation of one of the hubs only, the member contacting the hub permits the hub to rotate while the member contacting the other hub prevents the other hub from rotating.

The spring cartridge may further comprise a housing secured within the lock housing, and the independently moveable members may comprise first and second pins slideable with respect to the spring cartridge housing. The first and second pins may have a first end adapted to contact an outer surface of the first and second hubs, respectively, and a second end in contact with a spring retained by the spring cartridge housing to bias the first and second pins against the outer surface of the first and second spindle hubs, respectively, the first and second pins being independently actuable along a longitudinal axis of the spring cartridge housing in response to rotation of the first or second hub.

Each of the first and second spindle hubs may include a detent in an outer surface, wherein the first ends of the first and second pins are engageable with the detent in the outer surface of the first and second spindle hubs, respectively.

The spring cartridge may further comprise a roll pin positioned transversely through the spring cartridge housing, wherein the spring is retained by the roll pin. The spring cartridge housing may include a lip adapted to be held within a slot in the cover plate.

In an embodiment, the mortise lock may comprise at least one sensor on the lock adjacent the first and second hubs, respectively, for monitoring rotation of the hubs, wherein the at least one sensor is capable of being actuated by a magnet mounted on at least one of the first and second hubs. The mortise lock may further include at least one locking sensor on the lock adjacent each of the first and second hubs, respectively, for monitoring a moving lock component engageable with the hub alternately to prevent and permit movement of the hub and latchbolt.

Each hub may have a slot therein and the moving lock component may comprise a locking member moveable into and out of engagement with the hub slot alternately to prevent and permit movement of the hub and latchbolt, wherein the locking sensor senses the position of the locking member in or out of engagement with the hub slot. A magnet may be connected to the locking member and moveable therewith between a first position wherein the locking member is in engagement with the hub slot and a second position wherein the locking member is out of engagement with the hub slot, wherein the locking sensor senses the position of the locking member magnet. The mortise lock may also include a hub return spring contacting the first and second spindle hubs.

In yet another aspect, the present invention is directed to a method of operating a mortise lock, comprising providing a mortise lock including a lock housing and first and second spindle hubs rotatable by a handle to open and close a latchbolt, the hubs being alternately lockable and unlockable to prevent and permit movement of the hub and latchbolt; providing a spring cartridge comprising two independently moveable members, one member in contact with the first spindle hub and the other member in contact with the second spindle hub, wherein upon rotation of one of the hubs only, the member contacting the hub permits the hub to rotate while the member contacting the other hub prevents the other hub from rotating; rotating one of the first or second spindle hubs to move the hub and actuate the contacting spring cartridge moveable member; and biasing the other of the spring cartridge moveable members against the outer surface of the other of the first or second spindle hub to prevent rotation of the hub.

The method may further comprise providing at least one sensor on the lock adjacent each of the first and second hubs, respectively, for sensing rotation of the hub, the at least one sensor capable of being actuated by a magnet mounted on at least one of the first and second hubs, and the method may further include the step of monitoring the at least one sensor to determine whether the hub has been rotated.

Each hub may have a slot therein and the mortise lock may further include providing a locking member moveable into and out of engagement with the hub slot alternately to prevent and permit movement of the hub and latchbolt, wherein the sensor senses the position of the locking member and the step of monitoring the sensor includes determining whether the locking member is in or out of engagement with the hub slot.

The method may further comprise providing a magnet connected to the locking member and moveable therewith between a first position wherein the locking member is in engagement with the hub slot and a second position wherein the locking member is out of engagement with the hub slot, and the step of sensor senses the position of the locking member magnet.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIGS. 8-10 are a perspective view of an assembled spring cartridge, a perspective view of an assembled spring cartridge with the spring cartridge housing removed, and an exploded perspective view, respectively, of an embodiment of a spring cartridge of the present invention.

DESCRIPTION OF THE EMBODIMENT(S)

Figure 1:
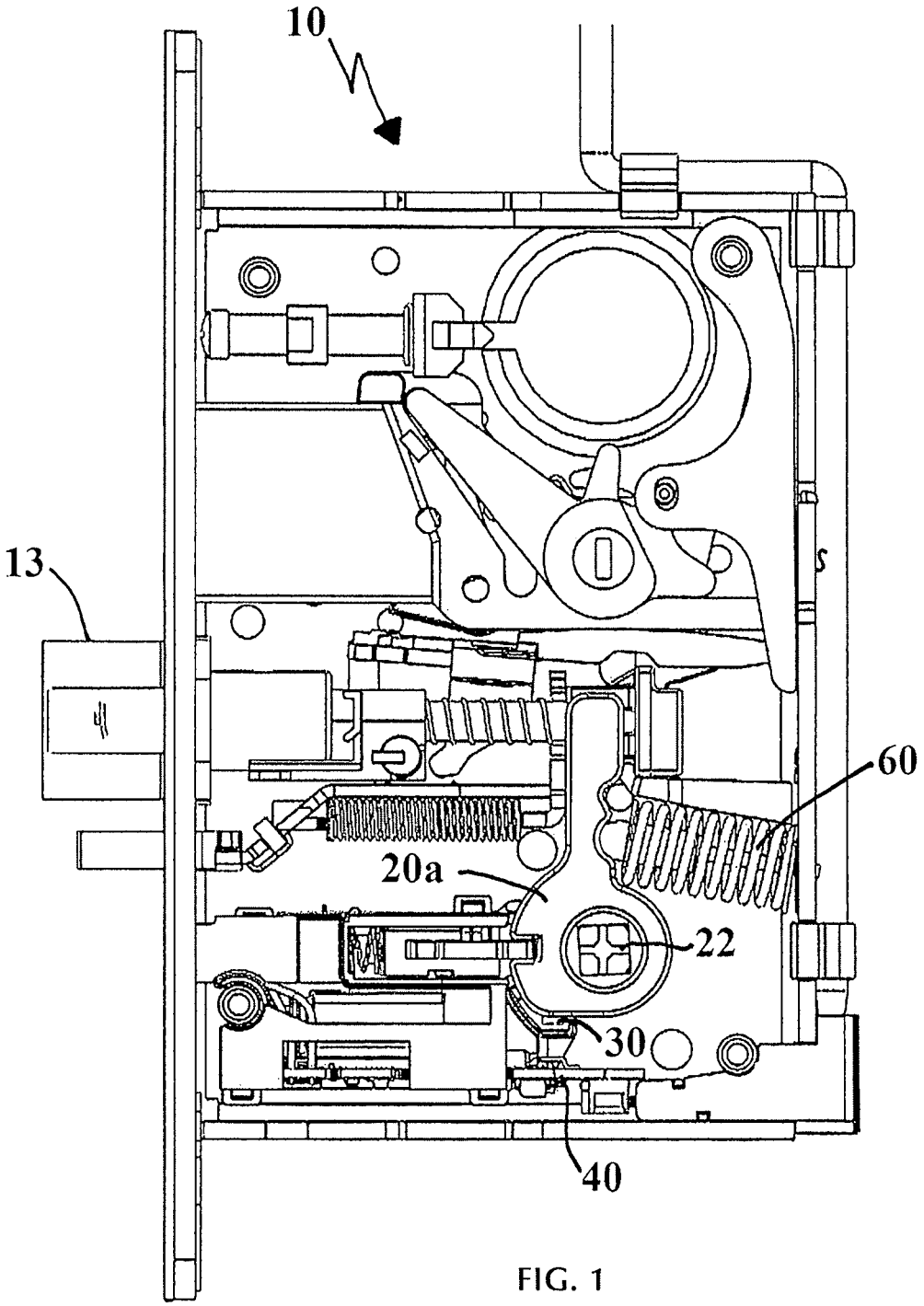
FIG. 1 (PRIOR ART)
FIG. 1 is a left side elevational view of a mortise lock design of the prior art, showing a hub return spring supporting both spindle hubs simultaneously. The cover plate of the mortise lock has been removed to show internal lock components.

In describing the embodiments of the present invention, reference will be made herein to FIGS. 1-10 of the drawings in which like numerals refer to like features of the invention.

Certain terminology is used herein for convenience only and is not to be taken as a limitation of the invention. For example, words such as "upper," "lower," "left," "right," "horizontal," "vertical," "upward," and "downward" merely describe the configuration shown in the drawings. For purposes of clarity, the same reference numbers will be used in the drawings to identify similar elements.

FIG. 1 depicts the internal lock components of an exemplary mortise lock of the prior art. In relevant part, mortise lock 10 includes a pair of spindle hubs 20*a*, 20*b* (not shown) having a lever or handle slot 22 therein for connection to an associated handle or lever (not shown) on the interior and exterior sides of a door, respectively. Hub 20*a* represents the "cap" side hub and hub 20*b* represents the "case" side hub. Rotation of the lever or handle on either side of the door results in movement of the associated hub 20*a* or 20*b*, thereby retracting latchbolt 13. In some prior art mortise lock designs, each moving lock component, e.g. the spindle hub, may be monitored, and may be provided with a magnet to actuate an associated sensor, such as a magnetic reed switch sensor, which monitors that component. For example, as shown in FIG. 1, a magnet 30 is mounted on the underside of spindle hub 20*a* and moves whenever an associated handle is rotated to retract the latchbolt 13, thereby activating a sensor 40, such as a reed switch sensor, positioned adjacent to the hub and magnet and producing an actuation or "Rx" signal which can be monitored by an external control unit. Similarly, a second magnet 30' (not shown) may be mounted on the underside of spindle hub 20*b*, for activating a second sensor 40' (not shown) positioned adjacent to the hub, during rotation.

During operation, mortise lock 10 requires the non-actuated lever or handle side of the lock to be supported to stop the hub from activating the sensor for that side of the door. In some mortise lock designs, as shown in FIG. 1, this is accomplished by means of a hub return spring 60 which supports both hubs 20*a*, 20*b* simultaneously by way of contact between the hub return spring 60 at or about the upper portion of each spindle hub. The hub return spring presents various performance obstacles, for instance, allowing for inadvertent activation of the sensor for the opposing side of the door during rotation of the handle due to imprecision of the spring-hub connection allowing for movement of both hubs simultaneously, and further, during actuation of the lever or handle on the opposite side of the lock, the non-actuated hub is left unsupported by the hub return spring.

Figure 2:
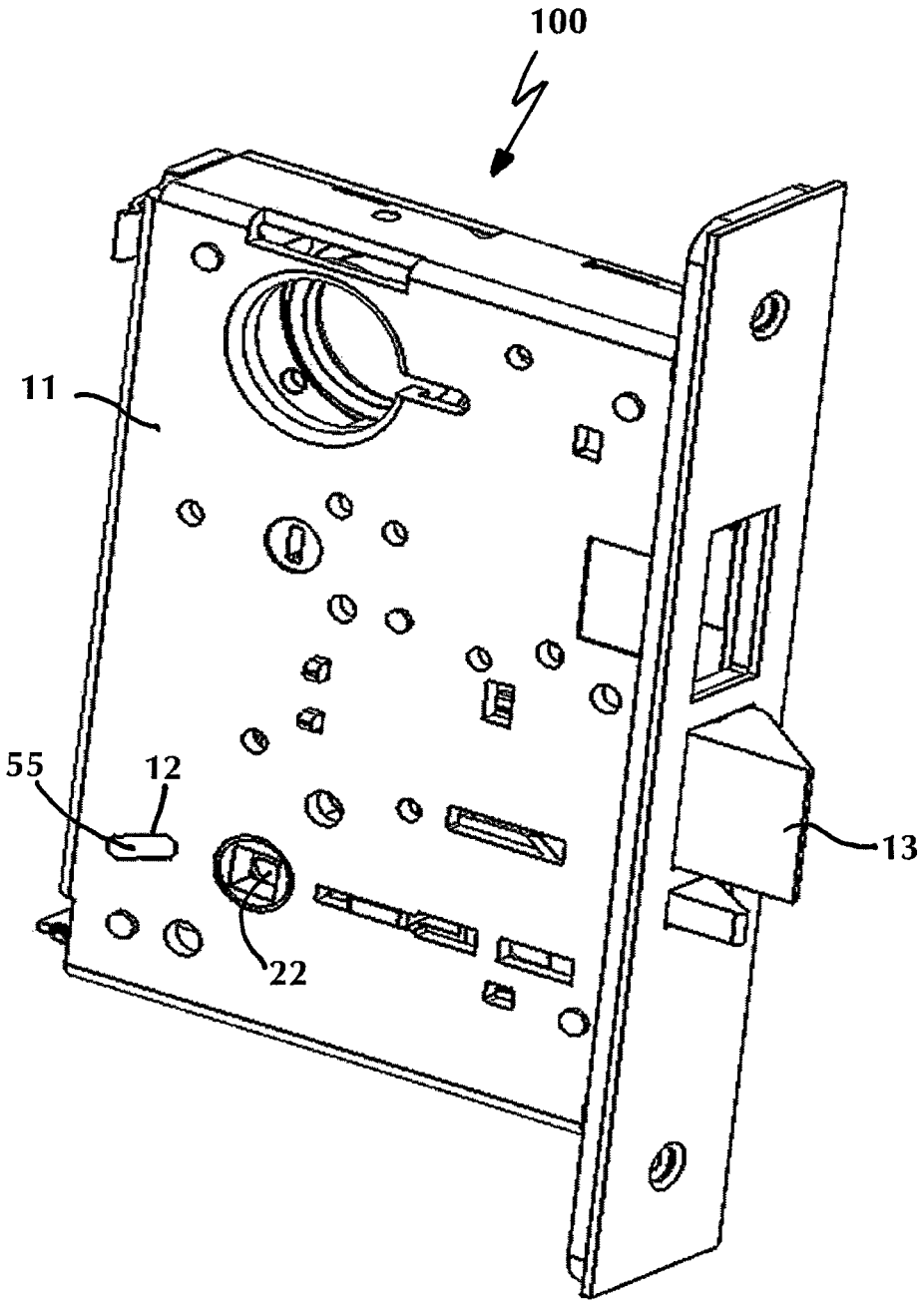
FIG. 2 is a perspective view of a mortise lock including an embodiment of the spring cartridge of the present invention, showing the spring cartridge secured in a slot of the mortise lock cover plate.
Figure 3:
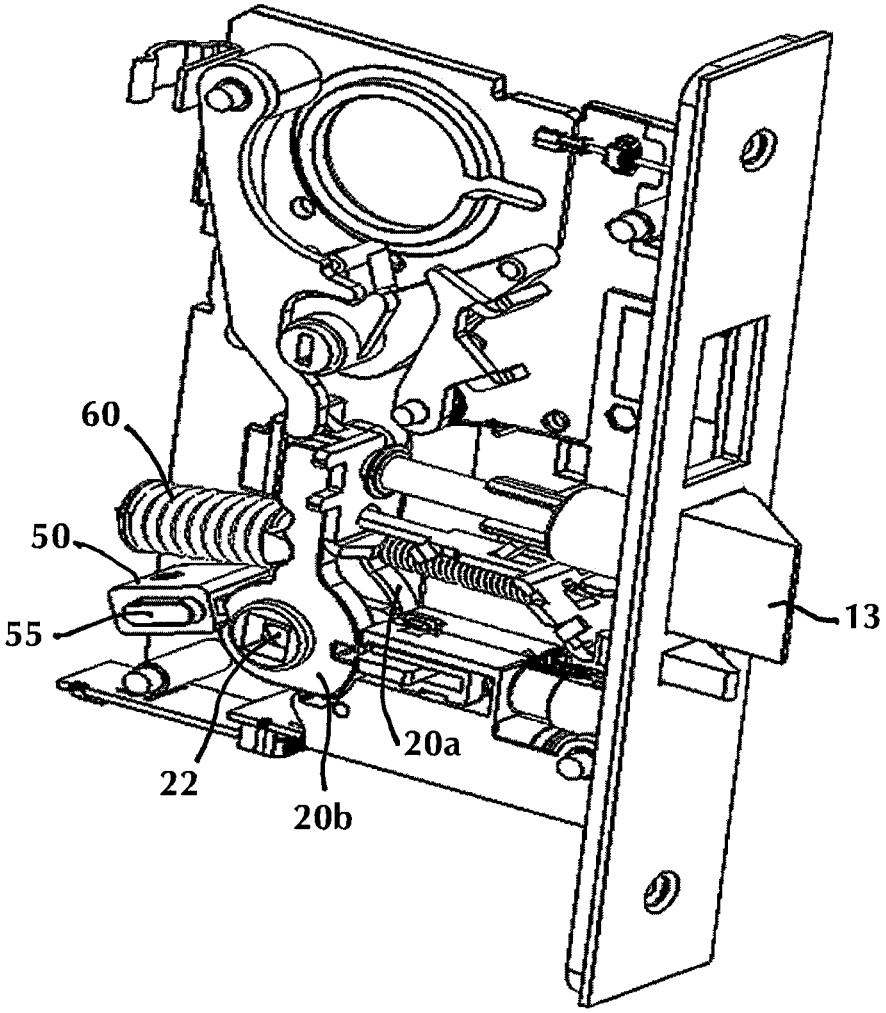
FIG. 3 is a perspective showing the mortise lock including an embodiment of the spring cartridge of the present invention as shown in FIG. 2, with the cover plate removed.
Figure 4:
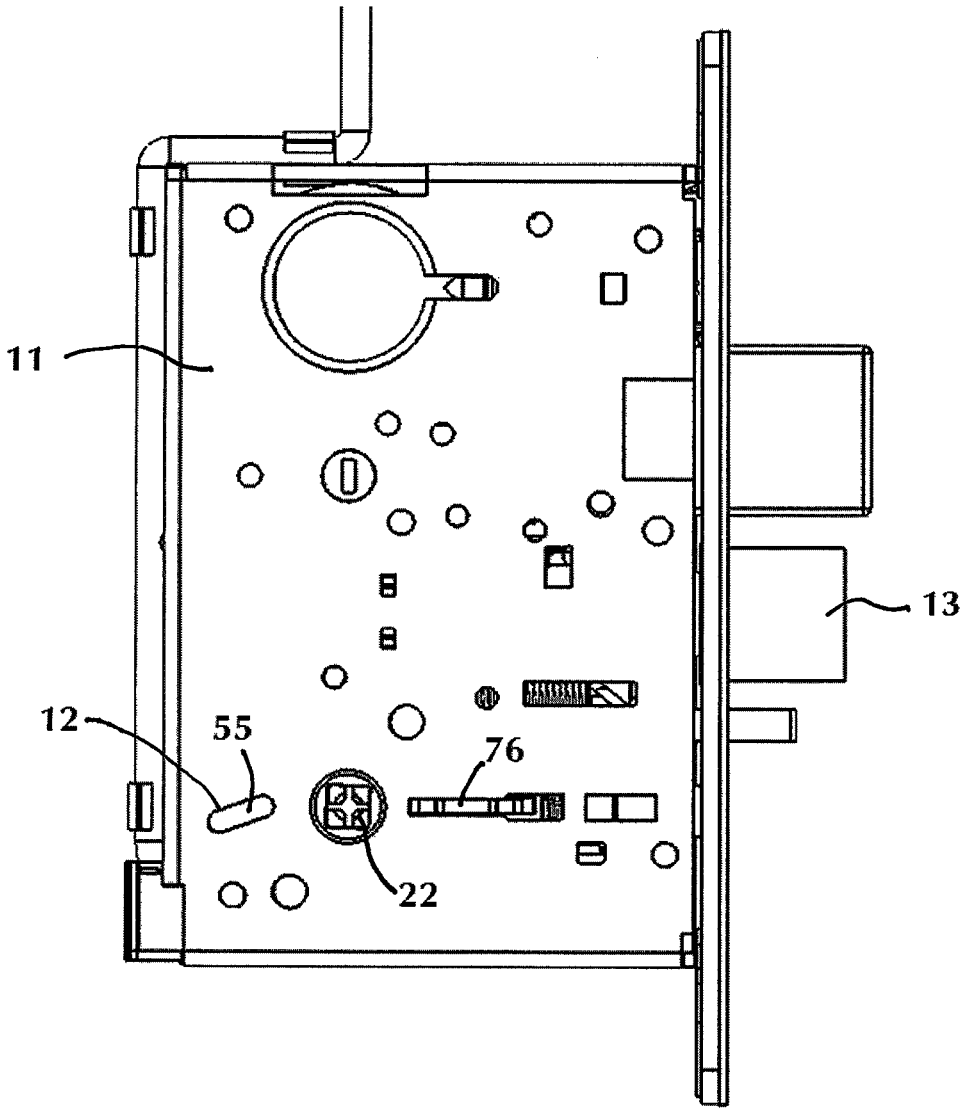
FIG. 4 is a side elevational view of the mortise lock including an embodiment of the spring cartridge of the present invention as shown in FIG. 2.
Figure 5:
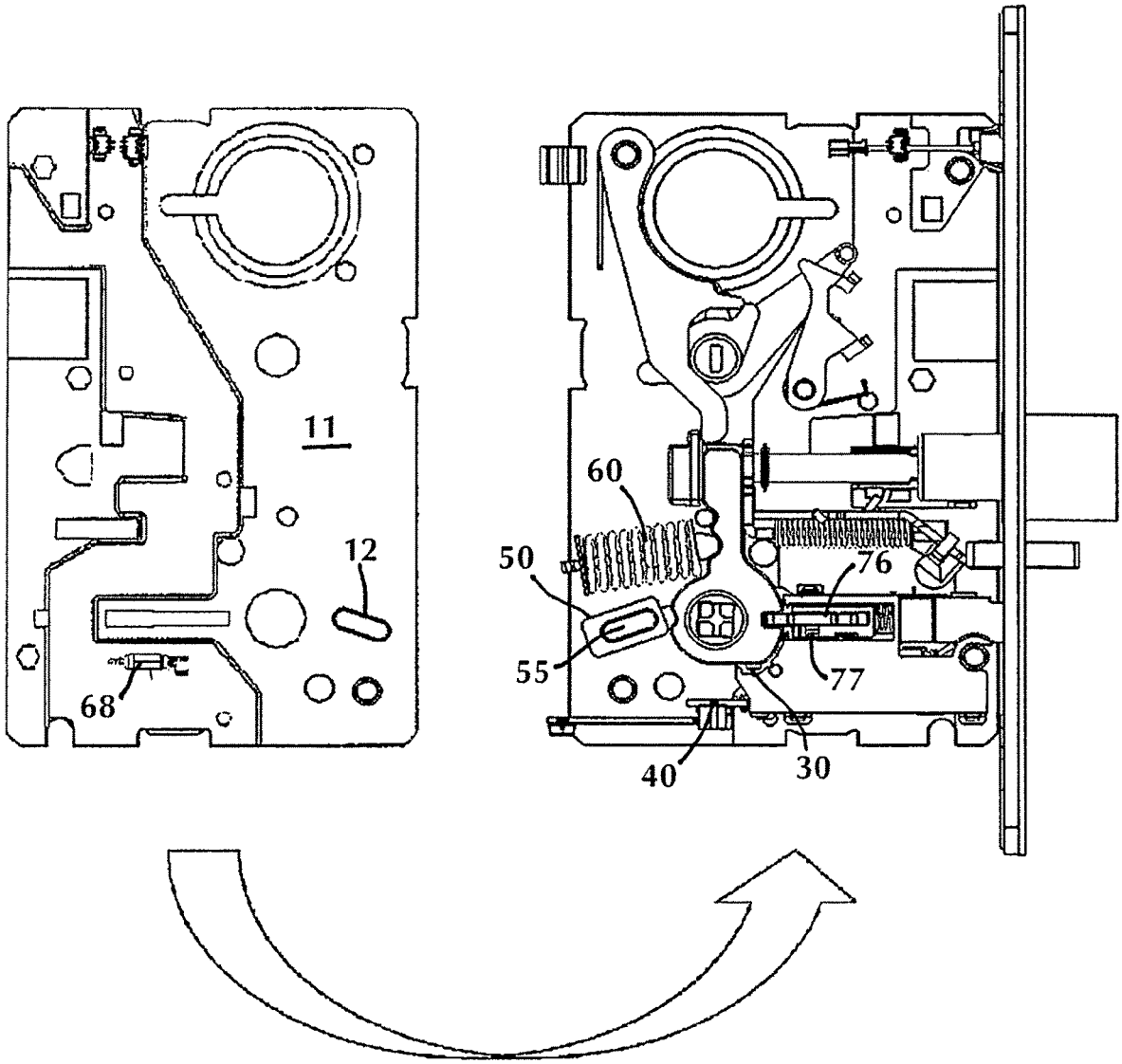
FIG. 5 is a side elevational view showing the mortise lock including an embodiment of the spring cartridge of the present invention as shown in FIG. 4, with the cover plate removed.
Figure 6:
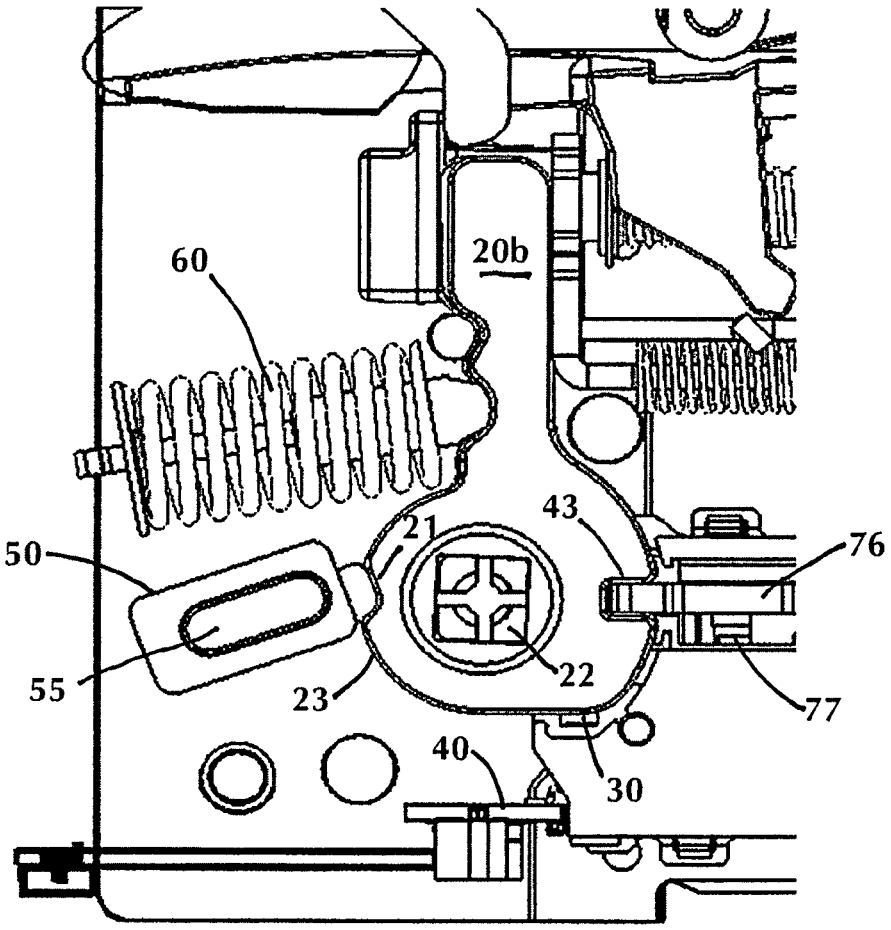
FIG. 6 is a magnified, side elevational view of the spring cartridge of the present invention in communication with the periphery of the case and cap side hubs, as shown in FIG. 5.
Figure 7:
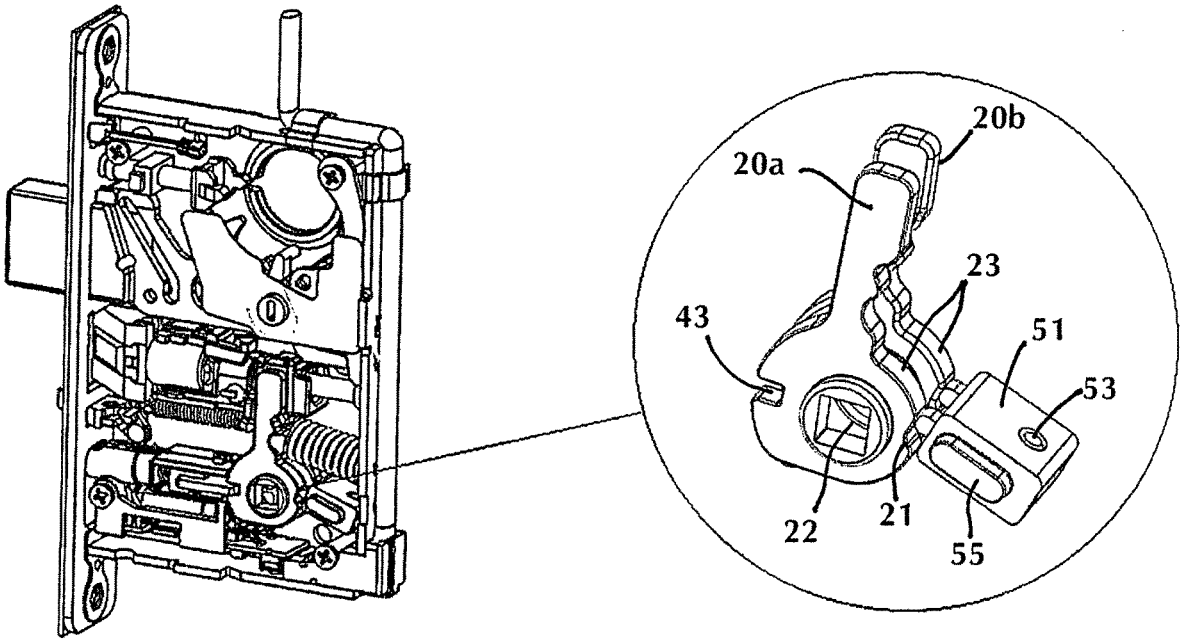
FIG. 7 is an isolated, perspective view of an embodiment of the spring cartridge of the present invention contacting detents in the periphery of the case and cap side hubs, as shown in FIGS. 2-6.

FIGS. 2 to 9 depict an exemplary embodiment of a mortise lock 100 including the independent Rx spring cartridge 50 of the present invention, which allows for independent internal support for each spindle hub. Spring cartridge 50 is adapted for engaging each of the cap side 20*a*' and case side 20*b*' hubs in the mortise lock and is adapted to be secured within the mortise lock housing and positioned, for example, between the spindle hubs and the wall of the housing, as shown in FIG. 7. As shown in FIGS. 2, 4, and 7-10, in an embodiment, spring cartridge 50 has a housing 51 which includes a lip 55 which is adapted to be secured in a slot 12 in mortise lock cover plate 11. It should be understood by those skilled in the art that the present invention is not limited to a lip-slot engagement as shown in FIGS. 2 and 4, and that the spring cartridge housing may be secured within the mortise lock housing by other known methods.

As best seen in FIGS. 9 and 10, spring cartridge 50 includes a pair of independently moveable members or pins 52*a*, 52*b* which are slideable with respect to the spring cartridge housing 51 and are independently actuable along a longitudinal axis of the cartridge housing in response to actuation of the cap side 20*a*' or case side 20*b*' hub, respectively. Each of the pins 52*a*, 52*b* has a first end 57 adapted to contact an outer surface 23 of cap side hub 20*a* or case side hub 20*b*, respectively (FIG. 10). As best shown in FIG. 6, in an embodiment, outer surface 23 may include a detent 21 comprising a notch or indentation in the periphery of the lower portion of hub 20*a* and 20*b*. It should be understood by those skilled in the art that in other embodiments, detent 21 may instead be, for example, a projection which mates with a concave or indented portion of the pin first end 57. As shown in the exploded view of FIG. 10, a spring 54 is retained by the spring cartridge housing 51 and is in contact with a second end 58 of the pins 52*a*, 52*b* to urge the pins against the detents 21 in hubs 20*a*, 20*b*, respectively.

In operation, when either of hubs 20*a*, 20*b* is actuated by rotation of a lever handle (not shown) inserted into handle slot 22, the corresponding contacting pin 52*a* or 52*b* is depressed against one end of spring 54, which in turn urges the other pin against the corresponding outer surface 23 of the adjacent hub, thereby preventing rotation. In one or more embodiments of the present invention, spring 54 may be a torsion spring. In at least one embodiment, spring 54 may be retained by a roll pin 53 which may be inserted through an aperture 56 in the spring cartridge housing 51 and positioned transversely with respect to pins 52*a*, 52*b* (FIGS. 8-10).

An advantage of the present invention is that when either hub is actuated, the corresponding contacting pin 52*a* or 52*b* is independently depressed or actuated, and the force is dispersed by the spring 54, allowing for each hub 20*a*, 20*b* to be supported by a separate force. The opposite pin is then urged by the other end of spring 54 against the corresponding outer surface of the adjacent hub. This configuration allows for the spring cartridge pins 52*a*, 52*b* to provide a constant support force on both hubs 20*a*, 20*b* simultaneously, while also independently supporting each hub. By allowing for independent support of each spindle hub, the performance obstacles found in the prior art hub return spring design may be eliminated. Moreover, in that the spring cartridge of the present invention is secured within the mortise lock housing, no additional prep work or boring is required during installation.

The independent hub support provided by the spring cartridge of the present invention, which permits rotation of only the hub actuated by a handle or lever and prevents rotation of the non-actuated hub, solves one of the problems of mortise locks of the prior art by preventing accidental activation of the sensor 40, 40' at the non-actuated side of the lock. As best seen in FIGS. 5 and 6, a magnet 30 is mounted on the underside of spindle hub 20*b* and moves whenever an associated handle is rotated to retract the latchbolt 13, thereby activating sensor 40, such as a reed switch sensor, positioned adjacent hub 20*b* and producing an actuation or "Rx" signal indicating rotation of hub 20*b*. Similarly, a second magnet 30' (not shown) may be mounted on the underside of spindle hub 20*a* (not shown), for activating a second sensor 40' (not shown) positioned adjacent to the hub, during rotation. The actuation or "Rx" signal for each hub may be monitored by an external control unit for anti-tampering measures, such as determining whether the hub 20*a*, 20*b* should be locked in response to command signal. For example, if an actuation signal is received with respect to a hub which should be locked, the external control unit can signal an alarm indicating that tampering has occurred. The independent hub support provided by the spring cartridge of the present invention increases tamper detection capabilities by preventing accidental activation of the sensor 40, 40' at the non-actuated side of the lock, thereby ensuring more accurate "Rx " signal detection.

The present invention further provides a means to determine if the spindle hub to be turned by the door handle is actually locked or unlocked, as measured by a sensor adjacent the hub and monitored by the control unit. In the example of the mortise lock, this determines if tampering has occurred to disengage the locking member from the hub slot. In the embodiment shown in FIGS. 5-6, sensor 68 attached to cover plate 11 is used to monitor locking piece 76, which translates in and out of engagement with a slot 43 in spindle hub 20*b* to lock and unlock the lock mechanism. Locking piece 76 is translated by an actuator assembly including a solenoid or motor upon receiving a signal from a control unit, for example, in an external device. The control unit may be a remote access control panel or the controller of an integrated locking device. As shown in FIG. 5, when the mortise lock cover plate 11 is installed, sensor 68 protrudes into close proximity with magnet 77 below locking piece 76. When locking piece 76 is translated to block the rotation of spindle hub 20*b* (lock is secured), magnet 77 activates sensor 68. Conversely, when locking piece 76 is translated to permit spindle hub 20*b* to rotate (lock is unsecured), sensor 68 is not activated.

Sensor 68 may be a form-C double throw magnetic reed switch sensor with three electrical contacts. Sensor 68's output state may be configured per design requirements to show a "normally open" or "normally closed" state and the output state will only change due to the translation of locking piece 76 as a result of a signal sent from an external control unit. Accordingly, sensor 68's output may be monitored by an external control unit which can directly detect an attempt to tamper with the lock assembly by manually and/or mechanically translating locking piece 76 to gain entry, thereby triggering an external alarm in the control unit. In normal operation, the external control unit sends a signal to activate the solenoid or motor to translate locking piece 76. If the control unit has not sent a signal to activate the solenoid or motor, a change in output state of sensor 68 will trigger an external alarm indicating that tampering has occurred. This tamper-detection circuitry may be designed in series with other sensors/switches, such as a sensor that detects the removal of a covering trim component, integrated reader, keypad, escutcheon or other external lock member.

Thus, the present invention solves one or more of the problems of mortise locks of the prior art. The present invention provides an internal solution for improved hub support, which allows for independent support for each spindle hub. The mortise lock of the present invention includes a spring cartridge mounted within the lock housing which comprises a pair of moveable members or pins which are slideable with respect to the spring cartridge housing and are independently actuable along a longitudinal axis of the cartridge housing in response to rotation of one of the spindle hubs. In operation, when either of the hubs is actuated by rotation of a lever handle, the corresponding contacting pin is depressed against one end of a spring retained within the spring cartridge, which in turn urges the other pin against the corresponding outer surface of the adjacent hub, thereby preventing rotation and accidental activation of the sensor on the non-actuated side of the lock.

While the present invention has been particularly described, in conjunction with specific embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A mortise lock comprising:

a lock housing comprising lateral cover plates;

a lock having first and second spindle hubs rotatable by a handle to open and close a latchbolt, the spindle hubs being alternately lockable and unlockable to prevent and permit movement of the spindle hub and latchbolt;

a hub return spring supporting both spindle hubs simultaneously at or about an upper portion of each spindle hub; and a spring cartridge including a housing secured within the lock housing and having a front surface and a rear surface, the spring cartridge comprising a spring retained by the spring cartridge housing and in contact with two independently moveable members extending beyond the spring cartridge housing front surface, one member in contact with the first spindle hub positioned on a cap side of the lock housing and the other member in contact with the second spindle hub positioned on a case side of the lock housing, the spring cartridge housing engaged with and transversely fixed between the lateral cover plates of the lock housing;

wherein upon rotation of a selected one of the first or second spindle hubs, a first portion of the spring is depressed by a corresponding one of the first or second members to permit the selected first or second spindle hub to rotate and the other of the first or second members is biased by a second portion of the spring away from the spring cartridge housing rear surface to prevent the other of the first or second spindle hubs from rotation.

2. The mortise lock of claim 1 wherein the independently moveable members comprise first and second pins slideable with respect to the spring cartridge housing.

3. The mortise lock of claim 2 wherein the first and second pins have a first end adapted to contact an outer surface of the first and second spindle hubs, respectively, and a second end in contact with the spring to bias the first and second pins against the outer surface of the first and second spindle hubs, respectively, the first and second pins being independently actuable along a longitudinal axis of the spring cartridge housing in response to rotation of the first or second spindle hub.

4. The mortise lock of claim 3 further including a detent in the outer surface of each of the first and second spindle hubs, and wherein the first ends of the first and second pins are engageable with the detent in the outer surface of the first and second spindle hubs, respectively.

5. The mortise lock of claim 3 wherein the spring cartridge further comprises a roll pin positioned transversely through the spring cartridge housing, the spring retained by the roll pin.

6. The mortise lock of claim 1 wherein the spring cartridge housing includes a lip at each side and each of the lateral cover plates of the lock housing includes a closed slot configured to receive and hold each lip therein.

7. The mortise lock of claim 1 further comprising at least one sensor on the lock adjacent the first and second spindle hubs, respectively, for monitoring rotation of the spindle hubs, the at least one sensor capable of being actuated by a magnet mounted on at least one of the first and second spindle hubs.

8. The mortise lock of claim 1 further including at least one locking sensor on the lock adjacent each of the first and second spindle hubs, respectively, for monitoring a moving lock component engageable with the spindle hub alternately to prevent and permit movement of the spindle hub and latchbolt.

9. The mortise lock of claim 8 wherein each spindle hub has a slot therein and the moving lock component comprises a locking member moveable into and out of engagement with the hub slot alternately to prevent and permit movement of the spindle hub and latchbolt, and wherein the locking sensor senses the position of the locking member in or out of engagement with the hub slot.

10. The mortise lock of claim 9 further including a magnet connected to the locking member and moveable therewith between a first position wherein the locking member is in engagement with the hub slot and a second position wherein the locking member is out of engagement with the hub slot, and wherein the locking sensor senses the position of the locking member magnet.

11. The mortise lock of claim 1 further including a hub return spring contacting the first and second spindle hubs.

12. A method of operating a mortise lock, comprising:

providing a mortise lock including a lock housing comprising lateral cover plate, first and second spindle hubs rotatable by a handle to open and close a latchbolt, the spindle hubs being alternately lockable and unlockable to prevent and permit movement of the spindle hub and latchbolt, and a hub return spring supporting both spindle hubs simultaneously at or about an upper portion of each spindle hub;

providing a spring cartridge including a housing secured within the lock housing and having a front surface and a rear surface, the spring cartridge comprising a spring retained by the spring housing and in contact with two independently moveable members extending beyond the spring cartridge housing front surface and being independently actuable along a longitudinal axis of the spring cartridge housing, one member in contact with the first spindle hub positioned on a cap side of the lock housing and the other member in contact with the second spindle hub positioned on a case side of the lock housing, the spring cartridge housing engaged with and transversely fixed between the lateral cover plates of the lock housing;

rotating a selected one of the first or second spindle hubs to depress a first portion of the spring by a corresponding one of the first or second members to permit the selected first or second spindle hub to rotate; and biasing the other of the first or second members by a second portion of the spring, the other of the first or second members being biased away from the spring cartridge housing rear surface against the outer surface of the other of the first or second spindle hubs to prevent rotation of the other of the first or second spindle hubs.

13. The method of claim 12 further including providing at least one sensor on the lock adjacent each of the first and second spindle hubs, respectively, for sensing rotation of the hub, the at least one sensor capable of being actuated by a magnet mounted on at least one of the first and second spindle hubs, and further including the step of:

monitoring the at least one sensor to determine whether the hub has been rotated.

14. The method of claim 13 wherein each spindle hub has a slot therein and further including providing a locking member moveable into and out of engagement with the hub slot alternately to prevent and permit movement of the hub and latchbolt and providing at least one locking sensor on the lock adjacent each of the first and second spindle hubs, respectively, wherein the locking sensor senses the position of the locking member, and the step of monitoring the sensor includes determining whether the locking member is in or out of engagement with the hub slot.

15. The method of claim 14 further including providing a magnet connected to the locking member and moveable therewith between a first position wherein the locking member is in engagement with the hub slot and a second position wherein the locking member is out of engagement with the hub slot, and wherein the locking sensor senses the position of the locking member magnet.

16. A mortise lock comprising:

a lock housing comprising lateral cover plates;

a lock having first and second spindle hubs rotatable by a handle to open and close a latchbolt, the spindle hubs being alternately lockable and unlockable to prevent and permit movement of the spindle hub and latchbolt;

a hub return spring supporting both spindle hubs simultaneously at or about an upper portion of each spindle hub; and a spring cartridge including a housing secured within the lock housing and having a front surface and a rear surface, the spring cartridge comprising a spring retained by the spring cartridge housing and in contact with two independently moveable members extending beyond the spring cartridge housing front surface, one member in contact with the first spindle hub on a cap side of the lock housing and the other member in contact with the second spindle hub on a case side of the lock housing, wherein the spring cartridge housing includes a lip at each side and each of the lateral cover plates of the lock housing includes a closed slot configured to receive and hold each lip therein;

wherein upon rotation of a selected one of the first or second spindle hubs, a first portion of the spring is depressed by a corresponding one of the first or second members to permit the selected first or second spindle hub to rotate and the other of the first or second members is biased by a second portion of the spring away from the spring cartridge housing rear surface to prevent the other of the first or second spindle hubs from rotation.

* * * * *